US008879971B2

(12) United States Patent
Taniguchi

(10) Patent No.: US 8,879,971 B2
(45) Date of Patent: Nov. 4, 2014

(54) SYSTEM, METHOD AND DEVICE FOR HEATING

(75) Inventor: Hideo Taniguchi, Kyoto (JP)

(73) Assignee: Hideo Taniguchi, Nishikyo-ku (JP)

( * ) Notice: Subject to any disclaimer, the term of this patent is extended or adjusted under 35 U.S.C. 154(b) by 146 days.

(21) Appl. No.: 13/468,692

(22) Filed: May 10, 2012

(65) Prior Publication Data

US 2013/0302072 A1 Nov. 14, 2013

(51) Int. Cl.
*G03G 15/20* (2006.01)

(52) U.S. Cl.
CPC ..... *G03G 15/20* (2013.01); *G03G 15/2053* (2013.01); *G03G 15/2017* (2013.01)
USPC ..... 399/328; 399/335

(58) Field of Classification Search
CPC ..... G03G 15/2014; G03G 15/2053
USPC ..... 399/328, 330, 335
See application file for complete search history.

(56) References Cited

U.S. PATENT DOCUMENTS

| | | | | |
|---|---|---|---|---|
| 5,499,087 | A * | 3/1996 | Hiraoka et al. | 219/216 X |
| 5,660,750 | A * | 8/1997 | Kusaka | 219/216 |
| 7,650,105 | B2 * | 1/2010 | Ogawa et al. | 399/328 X |
| 2005/0185978 | A1 * | 8/2005 | Kemmochi | 399/328 X |

* cited by examiner

*Primary Examiner* — Sophia S Chen
(74) *Attorney, Agent, or Firm* — Tungsten IP; Curtis Ray Droege

(57) ABSTRACT

A heating head, a heating apparatus using the heating head, and a heating method are disclosed. The heating head includes a strip-shaped heating resistive element configured for heating media which is used to write or erase records on a thermal rewritable media, for thermal transfer or re-transfer to the media, for toner fusing, adhesion or fusion by heating, for a transformation process by heating, for over-coating and document lamination process, for adhesion of sheets, for an imprinting process, such as an uneven surface process for plastics.

7 Claims, 13 Drawing Sheets

View A-A

SYSTEM, METHOD AND DEVICE FOR HEATING

FIELD OF THE INVENTION

The technology described herein relates generally to the fields of heating heads. More specifically, this technology relates to an apparatus using a heating head and methods thereof.

BACKGROUND OF THE INVENTION

Recently, reversible thermal sensitive recording media (rewritable cards/rewritable sheets) has increased in popularity. This process consists of a base, e.g., paper, nonwoven fabric, cloth, vinyl chloride, synthetic resins such as polyethylene terephthalate, film/sheet/card-form of metal and glass, and a recording part consisting of a thermal reversible recording layer which colors and de-colors repeatedly by heating.

Typically, a glass glaze layer is placed on a first side of a head substrate board, a strip-shaped heating resistive element is formed on the glass glaze layer and a pair of electrodes is placed on both ends of the strip-shaped heating resistive element. The electrodes are powered by wires on the wiring board, inserted through the backside of the head substrate board. The heating resistive element heats by voltage applied by the electrodes at both ends of the strip-shaped heating resistive element and the temperature of the strip-shaped heating resistive element is controlled by the amount of current. The head substrate board is attached to the aluminum base using an adhesive. A cavity on the base of the head substrate board is disposed under the strip-shaped heating resistive element to control heat escaping from the head substrate board to the aluminum base. Erasing occurs by the recording media being engaged by a roller and passing through in contact with the heating resistive element.

For toner fusing, heating from top and bottom is required. A heating roller fusing apparatus uses the heating rollers having a heater lamp, e.g., a halogen bulb, inside as fuser rollers. A heating belt fusing apparatus has a fusing roller which is connected to a heating roller with a belt; heating is done by pressing the media against the heated belt by the heating roller rotated to the fusing roller side and the pressing roller which has the heater internally.

There are multiple problems in the art. One is glass abrasion damage or unstable resistance value of the heating resistive element since the rubber roller and the heating resistive element are pressed together.

Another problem is that there are electrodes on both ends of the heating resistive element. However, it is not possible to connect the electrode surface and the wiring board directly as the media passes through the surface of the heating resistive element. This creates a complex manufacturing process since a connection has to be made on the backside of the substrate by making the connecting layer and connecting to the wiring board.

Another problem is the difficulty to maintain stable heating since the temperature drops if the media comes in continuously; this is due to the heat capacity of the heating resistive element being small when it is heated directly.

Another challenge for maintaining stable heating is that the temperature increases when there is no media coming in for a long period.

Another problem is that the power consumption increase and waste becomes an issue when the heater lamp is inserted into the heating roller to raise the whole body temperature for those cases of heating roller toner fusing apparatus or heating belt toner fusing apparatus.

An additional problem is the long duration for the heating roller surface to reach the predetermined temperature as well as keeping the heating roller surface temperature constant.

For toner fusing, heating from top and bottom is necessary. A heating roller fusing apparatus utilizes heating rollers which use a heater lamp, e.g., a halogen bulb, inside the heating roller to form a fuser roller. A heating belt fusing apparatus has a fusing roller connected to the heating roller with a belt. Heating is accomplished by pressing the media against the heated belt as the heating roller is rotated to the fusing roller side and by the pressing roller which has the heater internally.

Attempts to address problems in the art have been directed to configurations where the media does not engage the side where the heating resistive element is installed on the head substrate board, but instead engages on the opposite side of the side where the heating resistive element is, or, alternatively, on the lateral face of the heating resistive element.

However, when such a structure is employed it is not possible to make the surface completely smooth even if it is over-coated with a low friction coefficient and hard material such as diamond-like carbon on alumina, which the head substrate board is usually made of, which is very hard and lacks smoothness even if large protruding objects are pre-removed from the surface, unless the surface goes through lapping or polishing processes. Therefore media surfaces such as plastic or cardboard with wax-processed surface are easily damaged. On the other hand, there is increased cost issue if the head substrate surface processes were incorporated into the production steps.

One solution is a configuration where the heating head does not touch the media on the heating resistive element on the substrate board; the contact side is the backside of the heating resistive element side or lateral side which is adjacent to the side where the heating resistive element is on. Alumina which is usually used for the substrate board is hard and the surface is not smooth even if large protruding objects are pre-removed from the surface.

However, it is difficult to make this surface completely smooth even if the surface is polished or lapped with a layer of low coefficient of friction and hard material such as the diamond like carbon is formed. If this type of structure is used, the media, which is made of plastic or cardboard with wax-process, can be easily damaged. Also, there is an increased cost since the surface smoothing process is incorporated in the production steps.

BRIEF SUMMARY OF THE INVENTION

In various exemplary embodiments, the technology described herein provides a heating head, a heating apparatus using the heating head and a heating method. The heating head is comprised of a strip-shaped heating resistive element configured for heating thermal rewritable media, e.g., to write or erase records on the thermal rewritable media, for thermal transfer or re-transfer to the media, for toner fusing, adhesion or fusion by heating, for a transformation process by heating, over-coating and document lamination process, for adhesion of sheets, for an imprinting process (uneven surface process for plastics), etc.

Additionally, the technology described herein provides a heating head, a heating apparatus using the heating head and a heating method for heating media without pressing the heating resistive element directly, thus protecting the element surface. Also, the technology described herein provides for heating media evenly even if the heating widths are different due to media variation.

Erasing of recording media is comprised of heating the resistive element with electric power, pressing the media against the heating resistive element with a rubber roller thus transporting the media. The surface of the heating resistive element is comprised of a glass protective layer to prevent abrasion and potential short circuiting by the adhering of a foreign object.

The technology described herein solves the problems aforementioned. The technology described herein provides a heating head structure which does not press the heating resistive element directly, thus increasing durability, and does not damage the media which touches the heating head. Additionally the technology described herein provides a heating apparatus which uses the heating head. Lastly the technology described herein provides a heating method.

An aspect of the technology described herein is to provide a energy efficient heating apparatus and heating method by using a heating head structure which does not damage the media and reduces the wasteful consumption of power.

In an exemplary embodiment the heating head comprises a substrate board, a strip-shaped heating resistive element on the substrate board, a plurality of electrodes to supply voltage to the heating resistive element, a wiring board to connect to the electrodes and to a base. The substrate board is attached to the base so that the side on which the heating resistive element is not faces outward and presses the media; a spacer is placed between the pressing side and the media. The spacer is not attached to the pressing side of substrate board, but only a portion of the spacer is attached to the base or wiring board.

The media can be comprised of paper (including cardboard), nonwoven fabric, cloth, synthetic resins such as vinyl chloride, polyethylene terephthalate, film/sheet/card/plate-form of metal and glass, and the like. The media is further comprised of a recording material which has a layer of thermal reversible recording layer which colors and de-colors repeatedly by heating directed to the supporting material (rewritable card/rewritable sheet), thermal transfer or re-transfer to the media, recording paper used for toner fusing, adhesion or fusion by heating, transformation process by heating, over/undercoating and document lamination process and imprinting process. The pressing side is comprised of the external side of the heating head where the recording media passes through while it is heated.

The spacer is comprised of material having good thermal conductivity, e.g., copper sheet, stainless-steel sheet or phosphor bronze sheet, so that the heat from the heating head is transmitted quickly to the media. The spacer is far smoother than the alumina which is typically used for the substrate board and has a smaller coefficient of friction, so it is possible to heat the media continuously at a desired temperature range without risking damaging the media, even at a high transport rate. Since the media is not hard the result is that wearing of the spacer is minimal. Even if the spacer is worn out, it is easy to replace since it is not adhered to the pressing side of the substrate board. In one embodiment of the technology described herein the spacer is further comprised of a layer of chrome plating, DLC (diamond like carbon) or CrN is formed in order to make the surface harder and increase smoothness.

In an embodiment of the technology described herein, the heating head is comprised of a strip-shaped heating resistive element on a first side of a head substrate board; the backside of substrate is the media pressing side and faces the media to heat. The heating apparatus in this embodiment is comprised of a pressing side (a first side) of a heating head and a facing roller, and the apparatus heats the media while it is transporting. A spacer is placed between the heating head and the media on the heating apparatus. A portion of the spacer is attached to the chassis of the head periphery, or any other appropriate location, except the head substrate board.

Another aspect of the heating apparatus of this invention is shown in FIG. 5, in which there is one heating roller and another roller facing, which can be a heating roller or pressing roller. The heating apparatus heats the media while it is transported between the heating roller and heating body or pressure roller. The heating roller's surface is heated by the heating head upstream of roller's media contacting location.

This heating apparatus fuses the toner which is transferred to the media by pressing the media between the two facing rollers. The two rollers are placed upstream of the location where the media is pressed and a heating head heats the surface of the roller. The heating head has a structure comprising a strip-shaped heating resistive element on a first side of a substrate board with the second side being the pressing side. A spacer is attached to the chassis of head periphery, or anywhere except the head substrate board, to be placed between the pressing side of heating head and the roller. As shown in FIG. 5, the spacer is attached to the chassis, resulting in a rigid connection.

There is a strip-shaped heating resistive element on the head substrate board, and the backside of the substrate is the pressing side and a spacer is placed between the pressing side of the heating head and roller. A portion of the spacer is attached to the chassis of the head periphery, or anywhere else except the head substrate board.

The heating roller heats the contacting media via the raised surface temperature. The roller's upstream is the side where the media comes into contact as the roller turns.

Another aspect of the technology described herein is for the heating apparatus to fuse the toner which is transferred on the media transported through the two facing rollers. Rollers are located upstream of media contacting point and their surfaces are heated by the heating head. There is a strip-shaped heating resistive element on the head substrate board, and the backside of the substrate is the pressing side. A spacer is placed between the pressing side of the heating head and roller. A part of the spacer is attached to the chassis of the head periphery, or anywhere else appropriate except the head substrate board.

An aspect of the heating method of the technology described herein is to heat the media through the spacer, which is placed on the backside of the head substrate board on which the strip-shaped heating resistive element is.

Another aspect of the heating method of the technology described herein is to press and heat the media while transporting that media between two facing rollers, of which one roller is a heating roller, and the heating roller's surface is heated by the heating head through the spacer upstream of the roller that presses the media.

The heating head of this technology maintains very stable heating for a long duration since the roller does not press the heating resistive element directly and the media does not pass through the element surface, hence heating resistive element damage seldom occurs. Alumna, which is used for the head substrate board, typically is very hard with a Vickers hardness Hv of about 1000. Even if large protruding objects are pre-removed from the surface, there is a possibility of damaging the surface of the media since it is not smooth. The technology described herein places a spacer between the substrate board and media. The spacer is made of metal sheet with good thermal conductivity and smoothness, so it conducts the heat from the heating head to the media efficiently so that the media can be transported smoothly without damaging. The spacer is made of metal sheet, e.g., copper, stainless-steel or phosphor bronze, and the surface coarseness can be made to 0.01 to 0.5 μm smoothness. This permits transport of the media at high speed without damaging the media.

The heating head of the technology described herein has a configuration in which the media does not press to be heated on the heating resistive element surface, thus the head life can be prolonged. The heat capacity of the heating part increases by heating the whole head substrate board so that the temperature is stable.

In the situation where a gap exists between the spacer and the heating head, and the spacer thermal conductivity is very good due to the spacer being thin, the spacer quickly reaches the same temperature as the heating head prior to being pressed against the media. As a result, whether the media is heated continuously or sporadically, it can be heated at a relatively stable temperature and with little temperature variation.

Manufacturing is simplified since wiring to the electrodes surface on the both ends of heating resistive element does not interfere with the passage of the media and there is no need to form the wiring circuit layer around the heating head. The heating head of the technology described herein is effective even if the surface of the heating resistive element is uneven. In the case where there is temperature variation, it is possible to form a partial covering layer on the surface of the heating resistive element to make the heating temperature uniform.

It is possible to heat the media at an accurate temperature without media damage even if the media is transported at high speed by using this heating apparatus and heating method which the spacer attached between the heating head and the media. In this case there is no spacer installed on the heating head, a similar effect is seen. For this embodiment of the heating apparatus and the heating method to heat the heating roller with the heating head through the spacer, the structure heats the heating roller's surface with the heating head facilitating accurately controlled temperature and heating of the media immediately afterward. Therefore, there is no need to heat the whole heating roller, making the device highly thermally efficient with precise temperature control of the heating roller. Additionally, durability of heating head and roller is very high and long life and high reliability of the heating apparatus is achieved, since the heating head is touching the heating roller through the spacer and there is no direct contact with the heating resistive element surface or head substrate board.

There has thus been outlined, rather broadly, the more important features of the technology in order that the detailed description thereof that follows may be better understood, and in order that the present contribution to the art may be better appreciated. There are additional features of the technology that will be described hereinafter and which will form the subject matter of the claims appended hereto. In this respect, before explaining at least one embodiment of the technology in detail, it is to be understood that the invention is not limited in its application to the details of construction and to the arrangements of the components set forth in the following description or illustrated in the drawings. The technology described herein is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the technology described herein.

Further objects and advantages of the technology described herein will be apparent from the following detailed description of a presently preferred embodiment which is illustrated schematically in the accompanying drawings.

BRIEF DESCRIPTION OF THE DRAWINGS

The technology described herein is illustrated with reference to the various drawings, in which like reference numbers denote like device components and/or method steps, respectively, and in which.

DETAILED DESCRIPTION OF THE INVENTION

Before describing the disclosed embodiments of this technology in detail, it is to be understood that the technology is not limited in its application to the details of the particular arrangement shown here since the technology described is capable of other embodiments. Also, the terminology used herein is for the purpose of description and not of limitation.

Figure 7A:
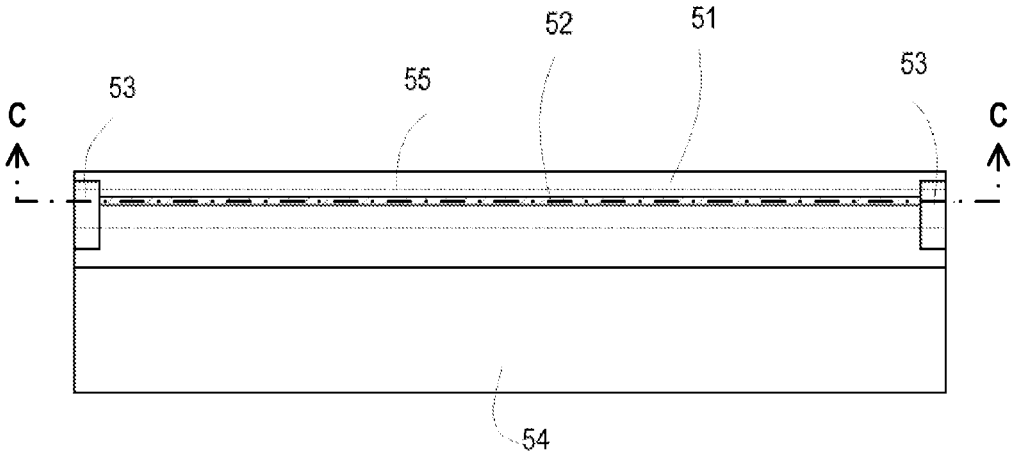
FIG. 7a Prior Art
FIG. 7*a* illustrates a construction example of a conventional application of a heating head.

In order to best highlight the differences between the technology described herein and conventional heating approaches, FIG. 7*a* illustrates a known heating head structure (prior art). FIG. 7*a* shows section C-C, resulting in cross-section C-C shown as FIG. 7*b*. A heating head is comprised of head substrate board 51 which is typically made of alumina and a glass layer (glaze layer) (not shown); a strip-shaped heating resistive element 52 is formed on top, and electrodes 53 are setup on both ends. The electrodes 53 are configured such that voltage is supplied through a wiring board (not shown) connected via a back side of the head substrate board 51. As a result, the heating resistive element 52 heats up when voltage is applied to both ends of the electrode pair 53 and the temperature of the heating resistive element 52 is controlled by the amount of current.

Figure 7B:
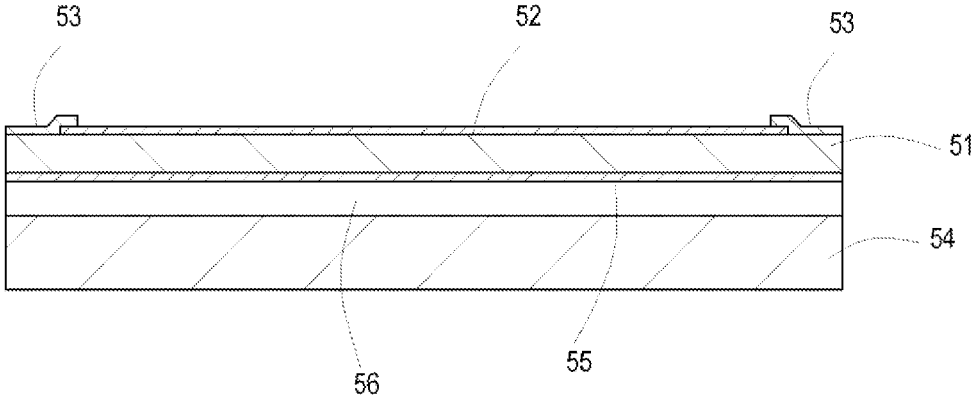
FIG. 7b Prior Art
FIG. 7*b* illustrates a cross section of FIG. 7*a*.

The head substrate board 51 is adhered and fixed with an adhesive 55 onto a base 54 which is made of material such as aluminum. The example illustrated in FIG. 7*b* shows a depressed part 56 formed on the base underside of heating resistive element 52 and the construction of a heat-sinking control from head substrate board 51 to a base 54. A process such as erasing is achieved by pressing the recording media (not shown), such as a card, and passing the media with the roller (not shown) through the heating resistive element 52.

Figure 8:
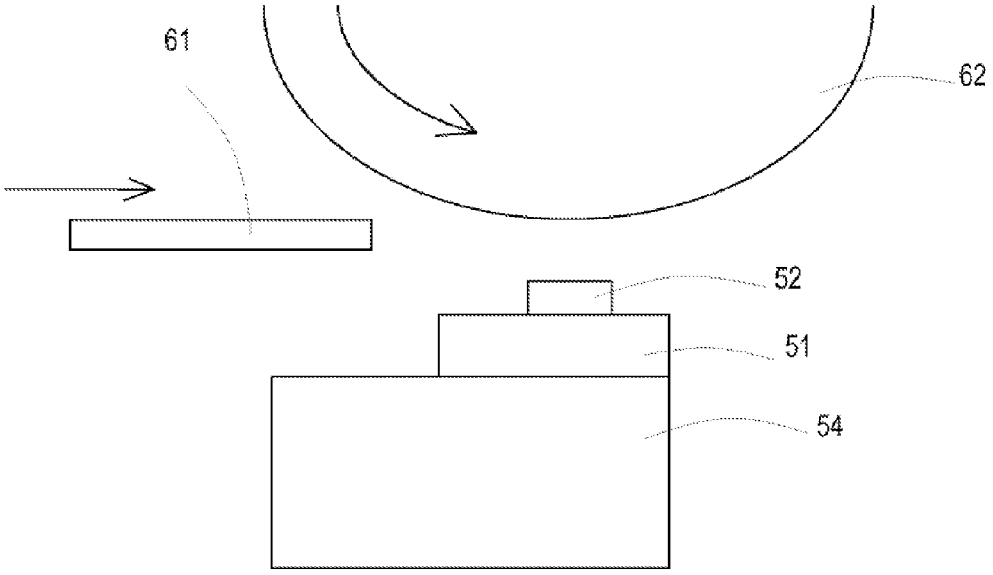
FIG. 8 Prior Art
FIG. 8 illustrates using a conventional heating head to heat a media.

Recording or erasing is performed by transporting the object to be heated such as a recording media 31 on to the heating resistive element 52, heating and pressing it with a rubber roller 62 as shown on FIG. 8. using a heating head such as this.

On the other hand, toner fusing requires to heat both from above and below, and there are some known apparatuses such as the heating roller fusing device, for example, which uses the heating roller 62 which has a heater lamp such as halogen bulb inside of the roller, or a heated belt fusing device which utilizes the fusing roller and heating roller which has the heater lamp inside tied together with a belt. The heated belt by the heating roller is rotated and the pressure roller which has the heater inside heats and presses the media together.

The printed record on the rewritable media can be erased when the media passes through the heating resistive element 52 while the voltage is applied to heat and pressed by the rubber roller 62. Although the surface of the heating resistive element 52 has a glass protective layer to prevent the abrasion and short circuit by the foreign particle adhesion, the rubber roller 62 is directly pressing the heating resistive element 52 in this scenario; there is a problem of the glass layer being damaged and getting worn-out, as well as the resistance value of the heating resistive element 52 being easily changed. In addition, there is a need for making a connection on the back side of the head substrate board 51 with the wiring board by forming the connecting layer through the side face of the head substrate board 51 to the back side of the head substrate board 51, since the media passes through the surface of the heating resistive element 52 and it is not possible to connect any wiring on the electrodes 53, which are located on both ends of the heating resistive element 52. Therefore, there is a problem of a complex production process. Additionally, even though the heating resistive element 52 is heating directly, the temperature goes down if the media is transported in continuously, as the heat capacity of the heating resistive element 52 is small. On the other hand, if the media is not transported in for a long period, the temperature tends to go up easily, creating a problem of maintaining uniform heating.

Figure 1A:
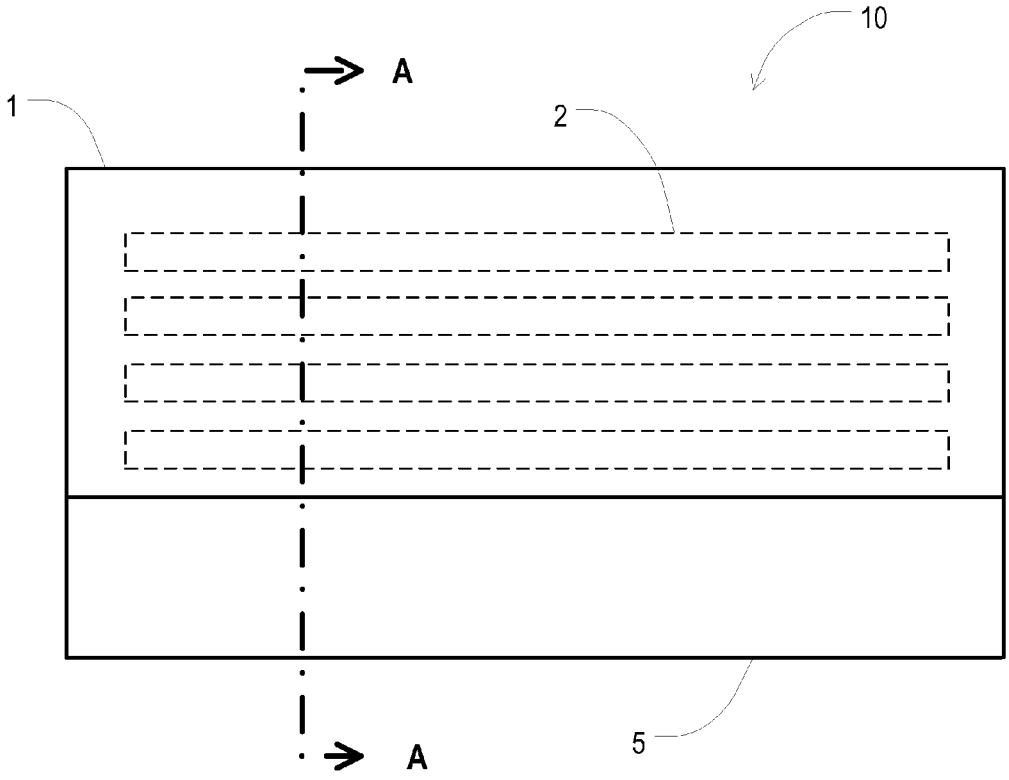
FIG. 1*a* is a top plan view of a heating head with the spacer removed, according to an embodiment of the technology described herein.

Referring now to FIG. 1*a*, a heating head 10 (with spacer 8 removed) is shown including a head substrate board 1, wiring board 5, and at least one strip-shaped heating resistive element 2 (hidden lines). Line A-A shows the section from which FIG. 1*b* is taken.

Figure 1B:
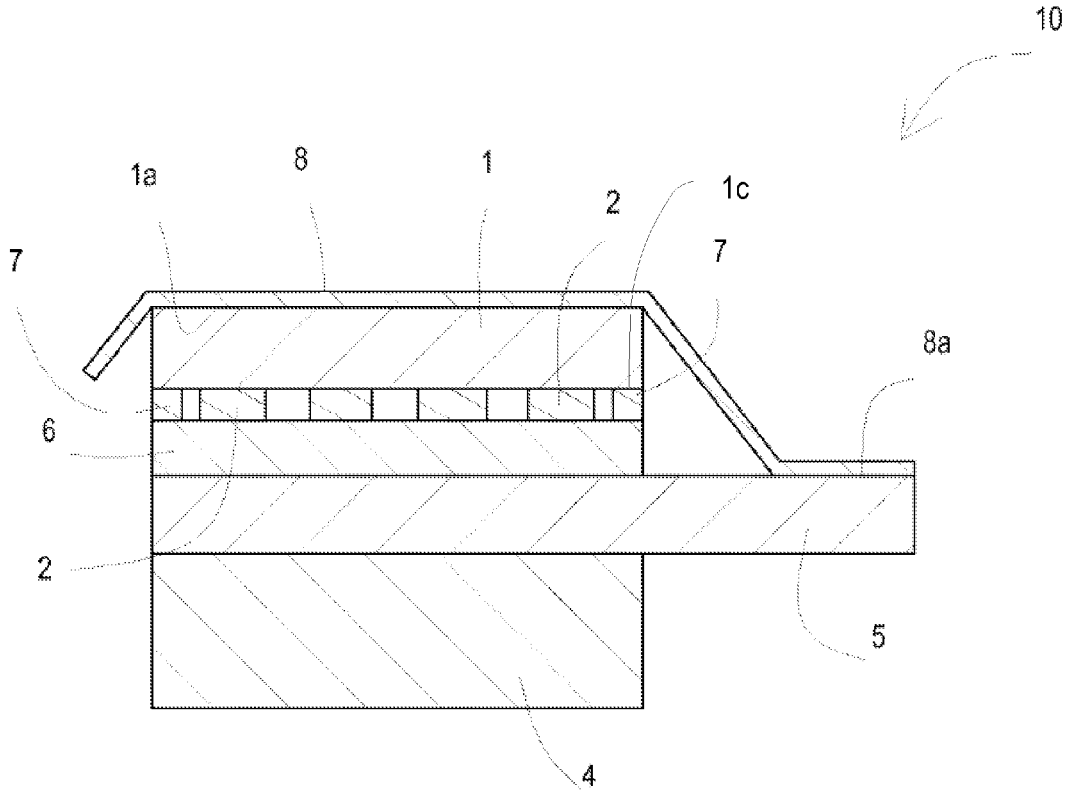
FIG. 1*b* is a cross section view of FIG. 1*a;*

FIG. 1*b* shows section view A-A of FIG. 1*a*, providing a cross-sectional view of heating head 10. Heating head 10 is comprised of at least one strip-shaped heating resistive element 2, which is set up on a plate-shaped head substrate board 1, a wiring board 5 is installed to connect electrically in order to supply voltage through a pair of electrodes 3 (shown in FIG. 4*a*) to both ends of the heating resistance element 2. Adhesive 7 is used to seal heating resistance element(s) 2 at least along the length of heating head 10. The head substrate board 1 is attached to a base 4. The side where the heating resistive element 2 is set up faces base 4, the other side 1*a* of the head substrate can press media 31 (the other side 1*a* is the pressure side), the head substrate 1 is fixed to the base 4 through a thermal insulation board 6 and a wiring board 5. The heating head 10 is further comprised of a spacer 8 installed such that the spacer 8 is positioned between the other side 1*a* of the head substrate board 1 and the media 31 when the media 31 is heated the spacer 8 is not fixed to the other side 1*a* of the head substrate board 1 but is fixed on either the wiring board 5 or the base 4. As a result, the structure is for the pressing side (other side) 1*a* of the head substrate board 1 to press the media 31 to heat as shown on FIG. 2 schematic illustration of the heating apparatus 15.

The head substrate board 1 varies based on the media 31 to be heated, for example, the length is about 40 to 3500 mm and the thickness is about 0.635 to 1.0 mm rectangular board, and the material is preferred to have a good thermal conductivity such as coefficient of thermal conductivity is about 1 (for example soda-lime glass) to 200 W/m K, thermally durable under the heating temperature conditions of application; the side on which the heating resistive element 2 is on is insulative, materials such as ceramics, like alumina and aluminum nitride, can be used. Metal plate such as stainless steel with an insulation layer which can be made by printing the insulation thick-film paste material and firing to thickness of 5 to 20 μm can be used.

In an embodiment of the technology described herein, the other side 1*a* of the head substrate board 1 (opposite face of the face where the heating resistive element 2 is set up) is the pressing side, since the side which faces the media 31 is intervened by the spacer 8, even when the alumina is used for the head substrate board 1 which has a coarse surface, the media 31 which is to be heated does not get pressed by head substrate board 1 directly (see FIG. 2), but is transported touching the spacer 8. There is a problem of the contacting side of the media 31 being damaged by the heating head contacting surface, which is hard and coarse (Vickers hardness Hv of about 1,000), and the media 31 is generally made of PET (poly ethylene terephthalate) or paper on which wax is applied. This technology described herein solves this problem by utilizing the spacer 8.

High thermal conductivity is preferred for the spacer 8 as the spacer 8 needs to heat up the media 31 by transmitting the heat from the other side 1*a* of heating head 10 to the media 31. In addition, low coefficient of friction, high flatness and smoothness are preferred as the media 31 is transported as being pressed.

The material (of spacer 8) preferred has a good thermal conductivity, flatness and smoothness (such as surface coarseness of 0.01 to 0.5 μm), and a metal sheet thickness of 0.1 to 0.3 mm made of copper, stainless steel or phosphor bronze (Cu—Sn—P alloy: mixture of Sn 3 to 9 wt %, P 0.03 to 0.3 wt %, impurity less than 0.5 wt % and rest is Cu) can be used. In other words, the material for the spacer 8 can be selected according to the media 31; if the media is soft, then a material with good thermal conductivity and flexible such as a copper sheet can be used; if the media 31 material is hard, then a hard material like stainless steel sheet can be used; for in between hardness, a material such as phosphor bronze is suitable. These metal sheets can be formed with high smoothness (and flatness), and the surface coarseness described above can be easily obtained. On the other hand, many those metal sheets are not hard and the surface may wear out quickly. However, as described later, the spacer 8 is not adhered to the back side of the head substrate board 1 and only fixed to a part of it to the wiring board 5 so that it can be replaced if it is attached with a screw 9*b* or other removable fastener.

Figure 2:
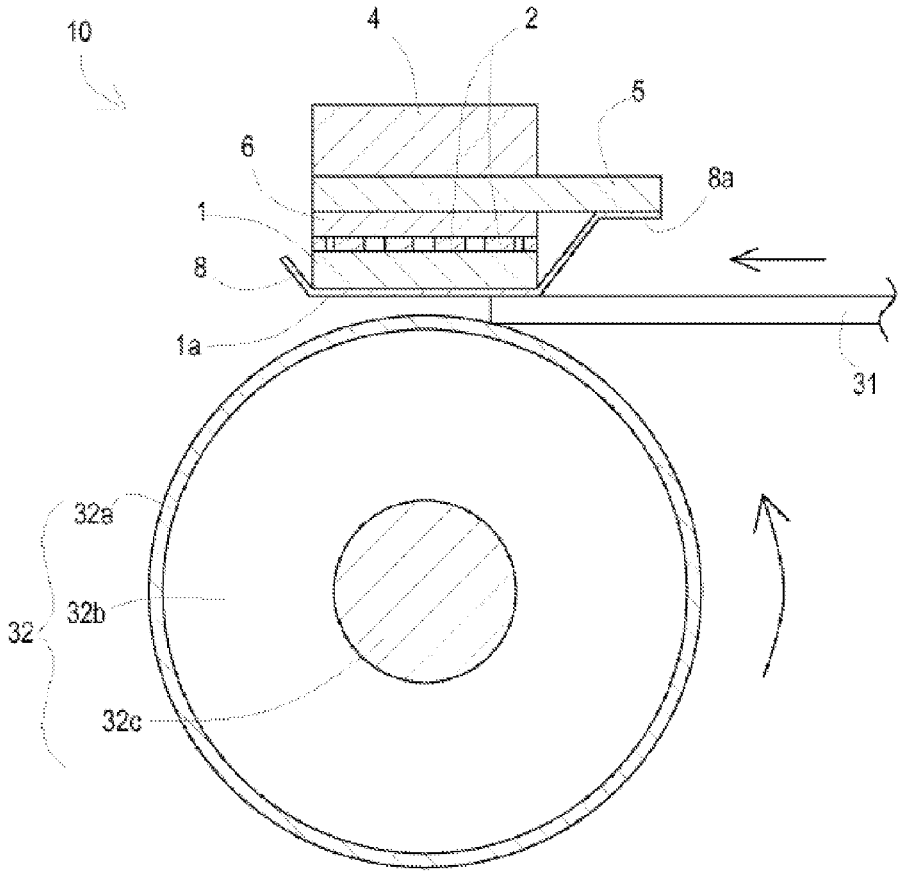
FIG. 2 illustrates a heating apparatus to heat a media using the heating head of FIGS. 1*a* and 1*b;*

In other words, the spacer 8 illustrated at least in FIG. 1*b* is drawn as contacting the back side (the other side) of heating head 10; there is no problem even if there is a gap to the back side (other side) 1*a* of the head substrate 1 in practical configuration as it will be press together with the media 31 and become in contact since end 8*a* is fixed to the wiring board 6 by either screw 9*b* or adhesive 7. The reason why the other side 1*a* and spacer 8 are not joined together is because the head substrate board 1 itself reaches about 250° C. and no adhesive 7 which has thermal conductivity at that temperature is available. If the spacer 8 and the head substrate board 1 are glued together completely, there will be warping and cracking of glue will occur; thermal conductivity will decrease due to the difference of thermal expansion coefficient of two materials with repeated on/off operation. Therefore, even if the temperature rises and the line coefficient of expansion is different, the two will contact certainly on flat face as they are free to each other and only one side is fixed so that the spacer 8 exists on the other side 1*a* of heating head 10. In addition, if the heating head 10 is used for the heating apparatus 15, the attachment of end 8*a* of the spacer 8 must be upstream of the media 31 as shown in FIG. 2; more specifically it has to be attached to the side the media 31 is inserted rather than the touching part of heating head 10 and media 31. By such installation, the configuration is that the spacer 8 is always in contact with the head substrate board 1 when the media 31 is transported in.

The heating resistance element 2 is set up to reach a part of a pair of electrodes 2 in strip-shape lengthwise. The example shown in FIG. 1*a* shows the same length (same characteristics) heating resistive element 2 with four in parallel formation, but the size and the number of heating resistive element 2 can be changed from 1 to 6 based on the media 31 to be heated. In addition, it is possible to provide a heating resistive element 2 which is separate from these for substrate temperature measurement, one of the aforementioned heating resistive elements 2 can be used for substrate board 1 temperature measurement or any arbitrary number and different lengths to accommodate the different heating length (media 31 width).

The heating resistive element 2 is made by applying a paste, for example Ag+Pd+glass, or silver and glass and formed by firing. Additionally, additive of $RuO_2$ can be used. In case the Ag—Pd alloy formation by firing, the sheet resistance of 100 mΩ/Sq to 500 mΩ/Sq can be achieved (varies based on composition, amount of solid insulation powder, thickness of printing, firing condition) and resistance value and temperature coefficient can be changed by the ratio of two ingredients. For example, sheet resistance value is about 200 mΩ resistance, width 5 mm, length 100 mm, thickness about 10 μm, (total resistance about 3.6Ω), coefficient of thermal resistance is about 1500 ppm/° C. (when temperature changes 100° C., resistance value changes 15%). This heating resistive element 2 is formed by printing to overlap the pair of electrodes 3 which are set up on both ends of the head substrate board 1 lengthwise.

The sheet resistance of the heating resistive element 2 is established based on the size of the media 31 to be heated and the media 31 processing speed (the speed to erase the record, that is to say the speed to pass over the heating head 10). For example, if the head substrate board 1 is 7 mm×104 mm×0.8 mm, which is width×length×thickness, made of alumina as the aforementioned case, it takes 1.76 J of heat quantity in order to raise the head substrate board temperature by 1° C. It will need 150×1.76=264 J in order to raise 150° C. If the resistance between the two electrodes between the heating resistive element 2 is made to be 3.6Ω, for example, it will produce 160 W of power when 24 V is applied, needed heat quantity is supplied in 264 J/160 W=1.65 seconds. In other words, it requires a duration of 1.65 seconds to get up to the predetermined temperature of 170° C., but once it reaches operating temperature it is possible to heat the media 31 continuously at a high media 31 passing speed without much temperature variation due to the magnitude differently large heat capacity compared with the existing narrow heating resistive element 2 only.

The heating resistive element 2 is formed on almost the whole size of the head substrate board 1 with an exception of about 2 mm from the edge in one or several in parallel. In the example shown in FIG. 1*a*, four elements of about 3 mm width are formed in parallel. In addition, it is possible to set up a resistive element 2 for head substrate board 1 temperature measurement in parallel with the heating resistive element 2, or it is possible to measure temperature using the heating resistive element 2. As shown in FIG. 1*a*, the heating resistive element 2 is formed on head substrate board 1 almost lengthwise, but one side of the pair of electrode 3 (shown in FIG. 4*a*) can be formed in common with several heating resistive elements 2, or an electrode can be formed in the middle point. The heating resistive element 2 for temperature measurement does not need to be the full length of the head substrate board 1; it can be formed in the middle part only, or made longer lengthwise than the head substrate board 1 and form multiple electrodes in the middle to measure the localized temperature. The connections to the electrodes in the middle can be made with adhesion, contact bonding or high temperature solder of a wire or flexible cable.

The heating characteristic of heating resistive element 2 is not limited to the previous example and can be designed with alternate materials, but the higher resistance temperature coefficient material is preferred for the temperature measurement resistive element 2 or heating resistive element 2 which is used for temperature measurement. Especially, for detecting the temperature using the heating resistive element 2 for control. which is discussed later, and preventing over-heating due to thermal runaway, the materials with 1000 to 3500 ppm/° C. are preferred. However, the structure of this technology is such that the heat is not applied directly by heating resistive element 2, but the media 31 is heated from the first side 1*a* of head substrate board 1 or end surface (corner side) 1*b* (see FIG. 4*b*) through the spacer 8 and it is unlikely that the thermal runaway will occur. So, even a material with a negative resistive temperature coefficient can be used. If the material has a large temperature coefficient, it is easier to measure the head substrate board 1 temperature and control the temperature.

Figure 6:
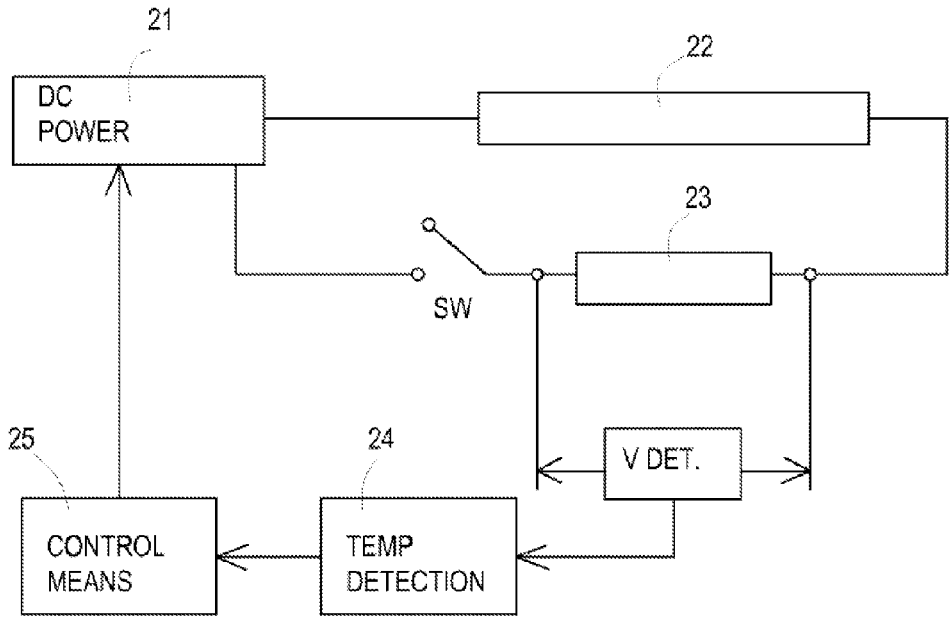
FIG. 6 illustrates a circuit diagram configured for measuring the head substrate temperature using a heating resistive element, according to an embodiment of the technology described herein.

When the heating resistive element 2 or temperature measurement resistive element (since heating is not the purpose, a finer heating resistive element 2 layer can be formed to get a large resistance change) is used to measure the head substrate board 1 temperature, (e.g., as shown in the circuit diagram of FIG. 6); connect a direct current (DC) power source 21 to the heating resistive element 2 and a standard resistor 23 in series. Measuring the voltage V across the standard resistor 23 and by the temperature detection means 24, the temperature can be sensed from the amount of voltage change and the known temperature coefficient of heating resistive element 2 (determined by the material). Depending on the sensed temperature, maintaining the head substrate board 1 temperature at a predetermined temperature by the control means 25 and controlling the voltage across the heating resistive element 2. The control means 25 can control the temperature by changing the direct current voltage applied to the heating resistive element 2 or by applying a drive pulse and adjusting the temperature by changing the duty cycle. In addition, a small resistance temperature coefficient is preferred for the standard resistor 23. Switch SW enables powering of the circuit shown in the circuit diagram.

Also, it is desirable to have a large (either negative or positive) temperature coefficient absolute value (%) for either temperature measurement resistive element or heating resistive element 2 used for temperature measurement. In addition, the location of the head substrate board 1 temperature measurement resistive element 2 is preferred to be set up on the appropriate position of the head substrate board 1 with the width of 0.3 to 0.5 mm, for example, if it is used only for temperature measurement and the applied voltage is desirable to be kept to about 5 V in order to avoid self-heating. From this, the temperature of head substrate board 1 section where the media 31 is pressed can be estimated.

A pair of electrodes 3 is formed by printing similar to the heating resistive element 2 on the end 8*a* of the head substrate board 1 lengthwise, in order to connect to the heating resistive element 2 with good conductor, such as silver-palladium alloy, which has a reduced palladium ratio than the heating resistive element 2 and Ag—Pt alloy. The pair of electrodes 3 is connected to the wire on wiring board 5, which is discussed later, but since the side of the pair of electrodes 3 is installed facing the base 4, there is no need for installing the wiring for connection on the backside of head substrate board 1 from the electrodes 3, as described later. Because the side where the pair of electrodes 3 or the heating resistive element 2 is on does not press the media 31 directly, there is no problem of surface unevenness, it is possible to gather in the center to form a connecting terminal for external connection or as mentioned before, to connect with direct adhesion, crimping or high temperature soldering. In addition, although it is not shown in FIG. 1*b*, the pair of electrodes 3 can be formed similarly at the same time if the substrate board 1 temperature measurement heating resistive element is installed.

Base 4 is used to hold the head substrate board 1 and is comprised of a metal plate, such as an aluminum plate (thermal conductivity coefficient: 221 W/mK), an iron plate (thermal conductivity coefficient: 83 W/mK) or ceramics such as aluminum nitride or aluminum oxide. Base 4 is made with a corresponding size of the aforementioned head substrate board 1 and a thickness of 7 mm, for example.

Wiring board 5 is, as mentioned before, made to connect a pair of electrodes 3 on the head substrate board 1 to supply voltage and to set up parts to detect the temperature of the aforementioned head substrate board 1, made of printed circuit board, for example, but it can be made with flexible film as described below. In addition, there is a case when a thermistor (not shown) installed on the head substrate board 1 is connected to the wiring board 5 to protect the head substrate board 1 from over-heating for double safety control. Additionally, a thermal fuse can be installed to cut off the voltage supply to the pair of electrodes 3 if the head substrate board 1 temperature goes up too high.

The aforementioned head substrate board 1 back side (the side where the heating resistive element 2 is on) is attached with adhesive 7 facing the base 4 through the thermal insulation board 6 on to the wiring board 5. The thermal insulation board 6 and wiring board 5 are fixed with the heat-resistant adhesive 7 (such as silicone-base resin or epoxy-base resin) (not shown), but they can be fixed with screws 9*b* as discussed.

The thermal insulation board 6 can be made of the same material and same thickness as the head substrate board 1, for example. However, it is possible to fix the head substrate board 1 on the base 4, along with forming the thermal insulation board 6 by injecting the above mentioned heat-resistant adhesive 7 with dispenser after making a dam (an embankment) around it and curing hard, for example. In another words, not much heat escapes as the thermal conductivity coefficient of silicone-based resin is about 0.15 W/mK and the thermal conductivity coefficient of alumina is 20 W/mK which the heat-resistant adhesive 7 thermal resistance is about 130 times higher. As a result, the temperature of the other side 1*a* of the head substrate board 1 goes up as the heating resistive element 2 heats up by the power distribution and sufficient heating is possible to write or erase the record on the media 31 by pressing against rubber roller 32 through the spacer 8.

Figure 3A:
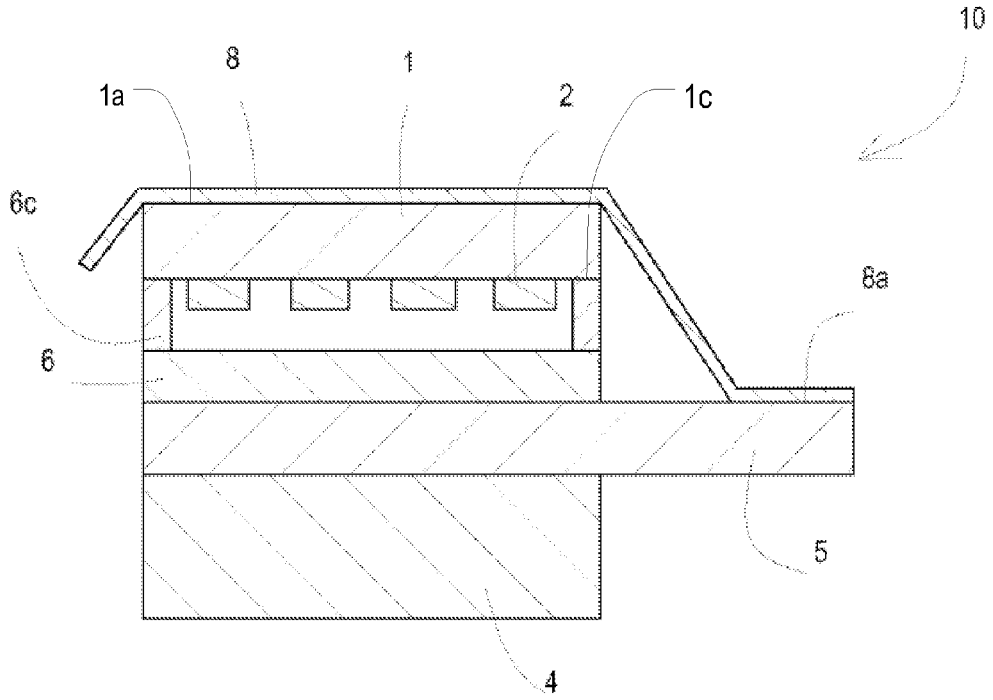
FIG. 3*a* illustrates another embodiment of the heating head of FIGS. 1*a* and 1*b;*

The example illustrated in FIG. 1*b* is the structure where the thermal insulation board 6 is glued directly on the surface of the heating resistive element 2 formed on the head substrate board 1; the heat-resistant adhesive 7 can be used as the thermal insulation board 6 since the thermal conductivity coefficient is 0.15 W/mK and about 130 times of alumina, as mentioned before. In order to prevent more heat leakage, it is preferable to leave the surface of the heating resistive element 2 in mid-air. This embodiment is shown in FIG. 3*a*. In order to create a space between the surface of heating resistive element 2 on the head substrate board 1 and the thermal insulation board 6, join the head substrate board 1 and thermal insulation board 6 through a column-shaped thermal insulation spacer 6*c*; as the embodiment shows in FIG. 3*a* has the same symbols for the same parts as FIG. 1*b*. For this embodiment, the insulation spacer 6*c* can be made of silicone-based resin or epoxy-based resin. In this configuration, the surface of the heating resistive element 2 is facing the empty space and does not touch anything, so the majority of heat is transmitted to the head substrate board 1.

Figure 3B:
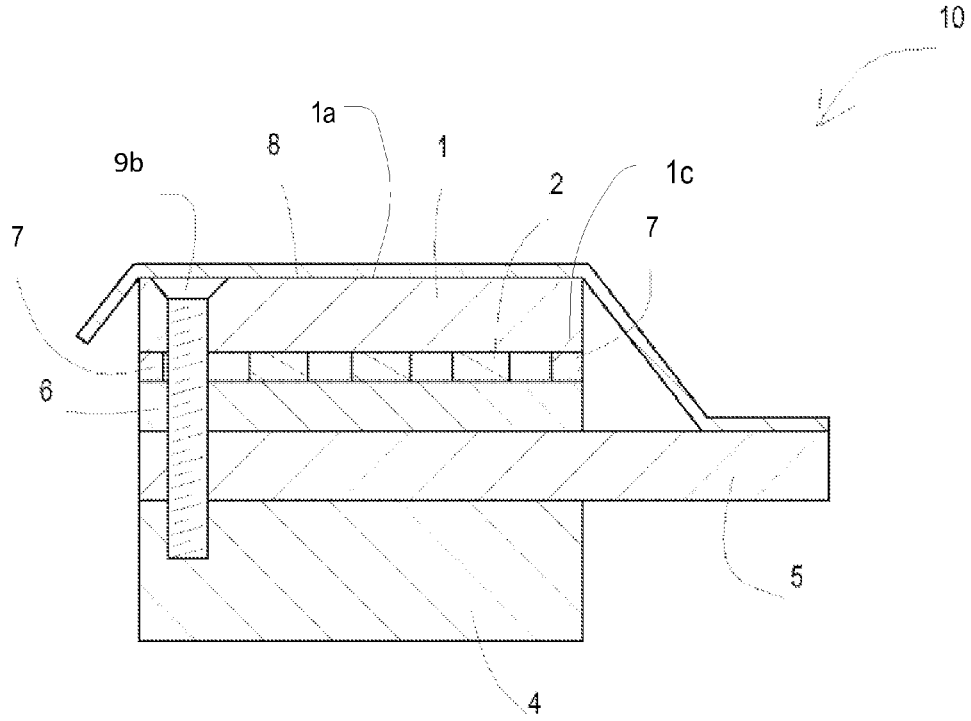
FIG. 3*b* illustrates another embodiment of the heating head of FIGS. 1*a* and 1*b;*

In addition, the head substrate board 1, thermal insulation board 6, wiring board 5 and base 4 are joined with the heat-resistant adhesive 7 on each of aforementioned example. There is a risk of cracking or shearing on adhesive 7 due to the ON/OFF operation cycles of heating head 10, since the head substrate board 1, wiring board 5 and base 4 are made of the materials of ceramics, glass-epoxy resin and aluminum plate, and the coefficients of linear expansion are all different. Examples of solutions to such problems are shown in FIG. 3*b* as well as FIG. 1*b*. In addition, the heating resistive element 2 is made of strips on FIG. 3*b* for convenience. In other words, the same symbols are used on FIG. 3*b* as the same parts on FIG. 1*b* and the explanation is omitted, but the head substrate board 1, thermal insulation board 6, wiring board 5 and base 4 are fixed with the screws 9*b*. The number of screws 9*b* is 2 to 5 based on the head substrate board 1 size. By making this configuration, reliability improves greatly because there is no cracking or shearing even if there is a difference in each coefficient of linear expansion in materials.

When the record is erased on the recording media 31 such as the rewritable cards using the heating head 10 as an erasing head, it can be done with the configuration shown in FIG. 2, a schematic illustration of a heating apparatus 15 using this technology. In other words, the erasing is accomplished when: the other side (pressing side) 1*a* of the heating head 10 is facing the rubber roller 32 through the spacer 8, raises the temperature of the other side 1*a* of head substrate board 1, i.e. spacer 8, up to the pre-determined temperature by distributing the power to the heating resistive element 2, by transporting the media 31 between the spacer 8 and rubber roller 32 and the temperature of media 31 is raised as the media 31 is pressed by rubber roller 32 and heating head 10. In addition, the temperature of the head substrate board 1 can be measured through the heating resistive element 2 as previously described, or the temperature of the media 31 contacting part can be measured by pre-measuring the temperature of heating resistive element 2 on the head substrate board 1 to correlate to the other side 1*a* or spacer 8 temperature beforehand, or by installing the temperature sensor-like thermistor nearby the pressing part or installing the heating resistive element 2 for temperature measurement as previously described.

In other words, although the heating apparatus 15 of this technology is similar in configuration to the conventional device as shown in FIG. 8, the configuration of this technology is not for the heating resistive element 2 on the heating head 10 to press the media 31 directly, and the backside, which is the other side of the heating resistive element 2 on the heating head 10, is the media 31 side and the media 31 touches the smooth spacer 8 in the middle to touch the media 31 rather than the head substrate board 1 directly, which is the characteristic of this technology. The heating apparatus 15 shown in FIG. 2 uses the heating head 10 which is shown in FIG. 1*b*. For this kind of heating apparatus 15, a heating head 10 without installing the spacer 8 is acceptable if the other side 1*a* of head substrate board 1 of heating head 10 is exposed to the outside and heating side of media 31. And the spacer 8 can be installed in order to contact the pressing side of the heating head 10 (the side which is exposed in order to heat with head substrate board 1). This spacer 8 can be installed on the un-shown chassis on which the heating head 10 is fixed. In this embodiment, the installation side is end 8*a* of the spacer 8 on the heating head 10 as shown in FIG. 2, since the spacer 8 is pulled as the media 31 is transported, upstream of media 31, from the pressing part of heating head 10 and the rubber roller 32, i.e. it is needed to fix on the side which the media 31 is not yet heated (When the media 31 is transported from right as shown on FIG. 2, one end of spacer 8 is fixed on the right side of spacer 81 contact point).

According to the application of the heating head 10 and the heating apparatus 15 of this technology, the media 31 can move contacting the smooth side of spacer 8 as shown in FIG. 2, as the media 31 is pressed by the other side 1*a* of head substrate board 1, which is the backside of the side where the heating resistive element 2 is on, and the rubber roller 32 through the spacer 8. Therefore, the media 31 does not move while pressed against the hard and coarse surface of head substrate board 1, but moves pressed against the smooth spacer 8 without damage and being heat-treated uniformly. In addition, the contact surface of spacer 8 can maintain smoothness and the damage by abrasion of spacer 8 can be prevented by forming a covering layer of Cr plating, DLC (diamond like carbon) or CrN.

FIG. 2 additionally shows the same configuration figure of rubber roller 32 as the heating roller 33 for heating, for example, the exterior surface is formed with a surface layer 32*a* made of heat-resistant rubber such as silicone rubber or fluorine rubber, and the inner layer 32*b* comprised of insulation rubber, e.g., such as foaming silicone rubber or fluorine rubber, on the center side, and fixed on the rotation shaft. However, the technology is not limited by this example.

Additionally, the media 31 is not heated by the heating resistive element 2 directly, but the media 31 is pressed against the spacer 8 and heated by the thermal conduction to the head substrate board 1 from the other side 1*a* of the head substrate board 1 where the heating resistive element 2 is installed, so the temperature distribution uniformity of the heating resistive element 2 is not required as much as the traditional use. However, the temperature distribution can be adjusted by coating the surface of heating resistive element 2 with a high thermal-conductive temperature dispersion layer on the surface of the heating resistive element 2 or trimming a part of the heating resistive element 2 as the media 31 does not pass through as the conventional way and the surface of the heating resistive element 2 is not required to be flat.

Additionally, the backside of the heating resistive element 2 is most easily heated up and the head substrate board 1 temperature is not uniform, but the spacer 8 is made of such material as copper sheet as previously mentioned and highly thermally conductive so the contacting face of the spacer 8 to the media 31 have a uniform temperature approximately the whole side. As a result, even the position where the rubber roller 32 does not press, the temperature of media 31 goes up as it passes through by touching the spacer 8 and gains preheating effect; recording or erasing of media 31 can be performed in a short amount of time as the temperature goes up even if the media 31 is passing through.

The heating head 10 of this technology has the configuration where the heating resistive element 2 on the head substrate board 1 faces the base 4 as it is mounted on base 4; it is possible to make the pressing side of the media 31 by rubber roller 32 and spacer 8 different from the side which the heating resistive element 2 on the head substrate board 1 is set up. As a result, the portion of the heating resistive element 2 where the temperature distribution is not constant can be coated with a heat dispersion material or a part of heating resistive element 2 can be trimmed, and the surface can be irregular. Additionally, the thickness of the head substrate board 1 is about 0.8 mm as previously described, so the usage temperature can be achieved in about 1.65 seconds once the power is supplied to the heating resistive element 2, since thermal conductivity coefficient of alumina is about 20 W/mK and even it is the opposite side of the heating resistive element 2 is set up. Besides, the heat capacity is larger than the heating resistive element 2 and the rapid temperature reduction does not occur even if the media 31 passes at a high speed and stable heating is possible continuously.

Figure 4A:
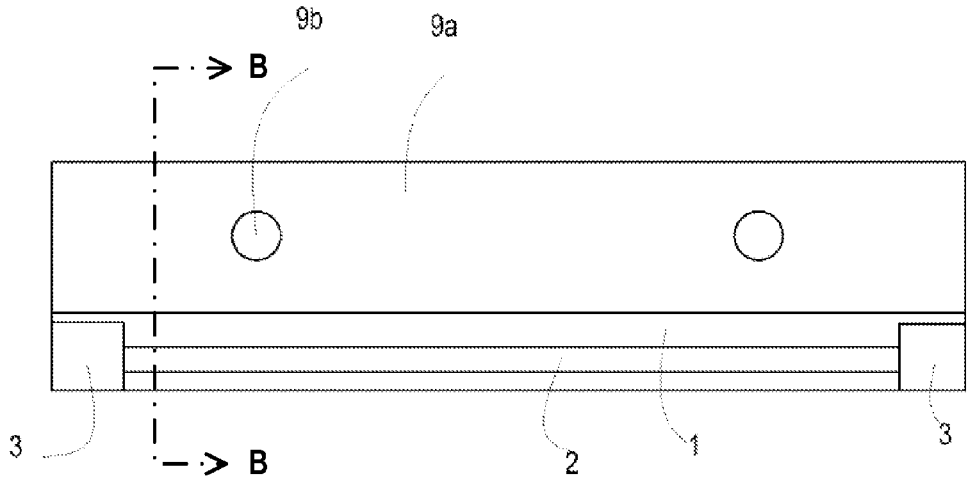
FIG. 4*a* is a top plan view of a heating head, according to an embodiment of the technology described herein.
Figure 4B:
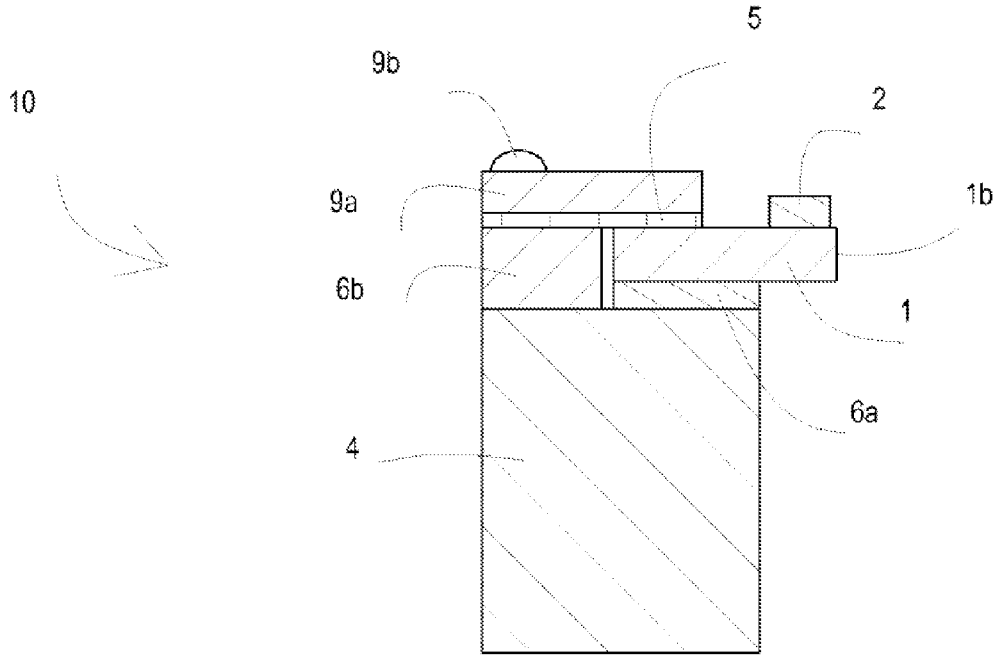
FIG. 4*b* is a cross section view of FIG. 4*a;*

In the previous example, the side heating resistive element 2 on the head substrate board 1 is facing the base to be fixed onto the base 4, the side heat resistive element 2 on the head substrate board 1 does not necessarily have to face the base 4 in order to the head substrate board 1 onto the base 4. FIG. 4*a* is a top plan view of an embodiment of heating head 10, which shows section B-B. This section is shown as FIG. 4*b*. In FIG. 4*b*, even if the heating resistive element 2 on the head substrate board 1 is fixed on the opposite side of base 4, the adjacent end surface 1*b* to the part where the heating resistive element 2 is set up is exposed and making the exposed end surface 1*b* as the heating side. The spacer 8 can be placed between the heating side and the media 31. In this case, the end surface 1*b* is alongside of the strip-shaped heating resistive element 2.

Figure 4C:
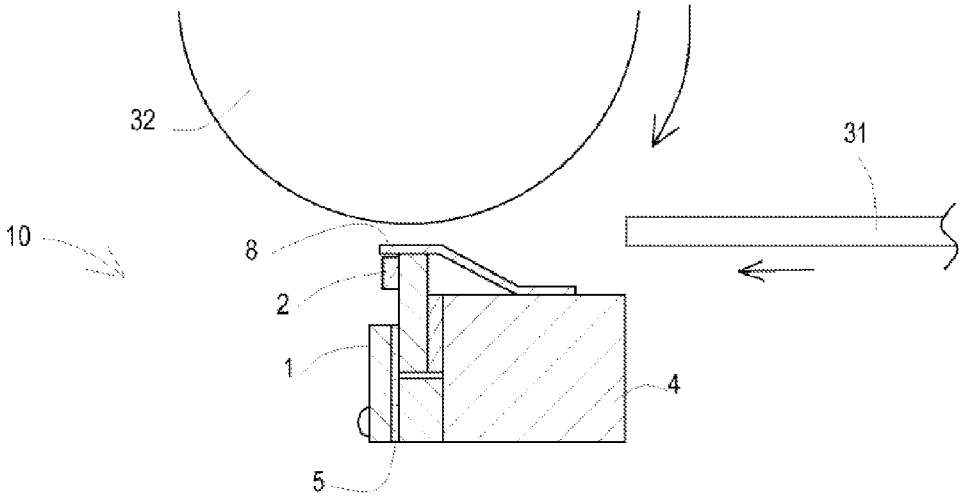
FIG. 4*c* illustrates a heating apparatus having a media entering an embodiment of the technology described herein.

In other words, the implementation configuration shown in FIGS. 4*a* and 4*b* is the head substrate board 1 which the heating resistive element 2 is set up is installed on base 4 through the first thermal insulation board 6*a*, second thermal insulation board 6*b* is sandwiched between presser bar 9*a* and screw 9*b* to be attached to base 4. The heating head 10, while the media 31 passes over the end surface 1*b* of head substrate board 1 and the rubber roller 32 presses through the spacer 8 as shown in FIG. 4 (*c*), it is possible to heat the media 31 smoothly while transporting using the smoothness of spacer 8 as well. Also, the spacer 8 is omitted on FIGS. 4 (*a*) and (*b*), one end can be fixed on base 4 as shown on FIG. 4 (*c*) or as described before, rather than attaching on the heating head 10, set up the spacer 8 to place between the pressing side of heating head 10 and the media 31 by fixing one end of the spacer 8 on the chassis (not shown) to which the heating head 10 is attached.

In addition, the wiring board 5 is made from a flexible film and installed under the presser bar 9*a* on the example shown on FIG. 4*b*. However, it can be made into the configuration as shown in FIG. 1*b* as previously described.

For the structure which used the end surface 1*b* of the head substrate 1 as the pressing side, the heating resistive element 2 can be established on both sides (first side 1*a* and second side 1*c*) of the head substrate board 1 by installing on the lower side of head substrate board 1 of FIG. 4*b* rather than only on one side. By making this type of configuration, the temperature of head substrate board 1 can be raised and stable heating is possible even the heat quantity from one of heating resistive elements 2 is reduced.

Figure 5:
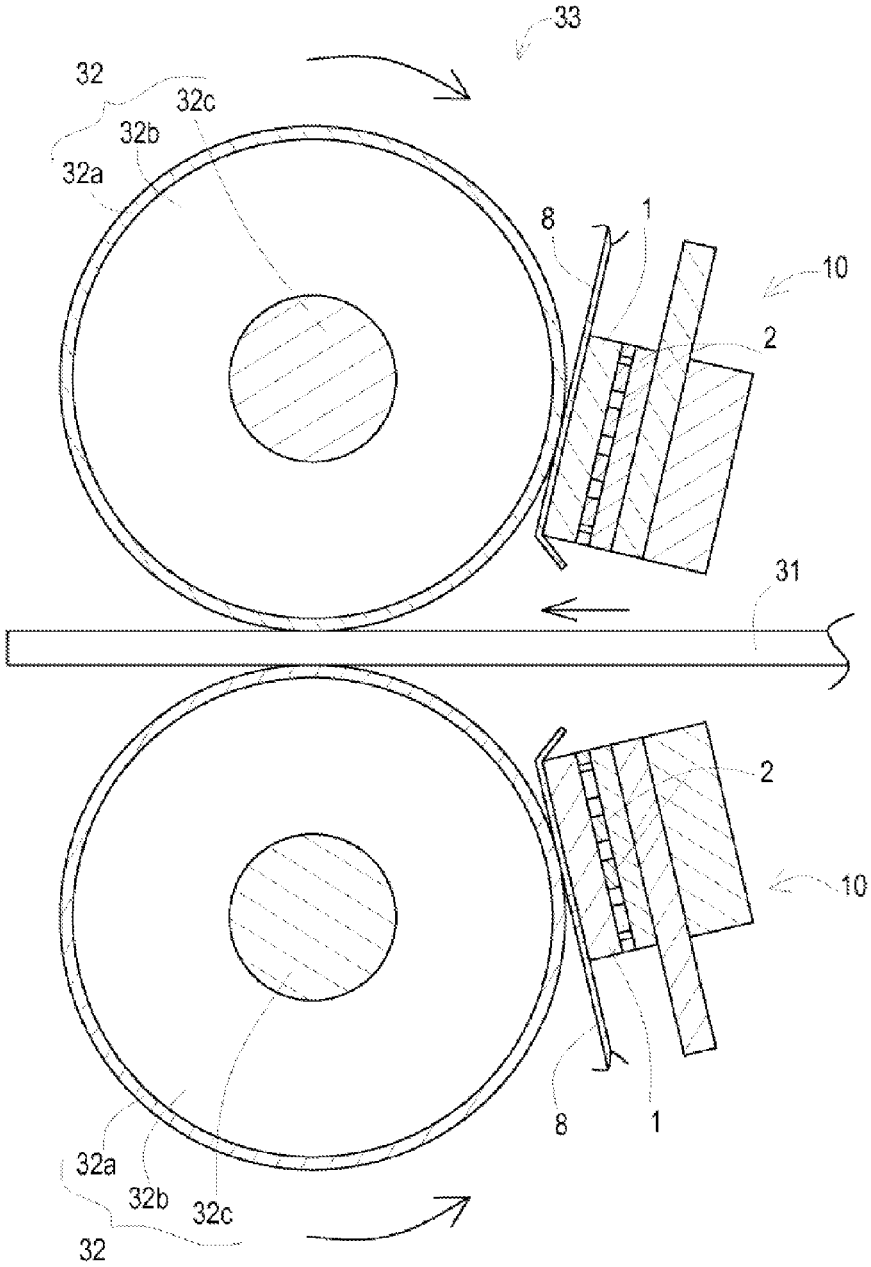
FIG. 5 illustrates an embodiment of a heating apparatus for the technology described herein.

FIG. 5 is an outline illustration of another implementation configuration of this technology.

This example shows the heating apparatus 15 which uses double-side heating by employing the heating roller 33 on both sides of the media 31 especially suitable for toner fusing. Instead of the configuration of heating up the whole roller by installing the heater inside of the roller for the heating roller 33, the characteristic of the technology is the heating configuration to heat only a part of the surface of rubber roller 32 to raise the temperature by using the heating head 10 as previously described. Thus, in the heating apparatus 15 shown in FIG. 5, the heating roller 33 has a special feature, the heating rollers 33 are not installed to heat the double side of the media 31, but it can be a single-side heating apparatus 15 and heating only one side of the media 31 while the other side is only to press, but not to heat, pressure roller, or the heating apparatus 15 can be with a heating head 10, as previously described, on one side and the other side can be with the heating roller 33.

In other words, the heating roller 33 used for the heating apparatus 15 of this invention is comprised of a rubber roller 32 and heating head 10 as shown on FIG. 5, the rubber roller 32 is similar in construction as the rubber roller 32 discussed in the FIG. 2 explanation; the exterior surface is made of heat-resistant rubber, e.g., silicone rubber or fluorine rubber, as the surface layer 32*a*, the inner layer 32*b* comprises insulation rubber, e.g. foaming silicone rubber or fluorine rubber, on the center side, and fixed on the rotation shaft 32*c*. Surface layer 32*a* transmits the heat received from the heating head 10 to the media 31; it is necessary to keep a higher temperature than the heating temperature of media 31 (normally 150 to 200° C.), as well as to be able to stand up to the pressure from the opposing rubber roller 32 or the heating head 10; and it is necessary to be elastic in order to maintain the footprint when pressing on the media 31, which is called nip. Therefore, rubber, as previously described, such as silicone rubber (desired hardness can be adjusted by adding the plasticizer) is used. In addition, the inner layer 32*b*, in order to help heating the media 31 by storing the heat on the surface layer 32*a*, which is received from the heating head 10 on surface layer 32*a*, to not let the heat escape toward the inner layer side 32*b*, can be made of the rubber with low heat conductivity coefficient such as mixture of foaming silicone rubber and partially additive (filler).

The heating head 10 structure can be applied to the heating head 10 shown in FIGS. 1*a* and 1*b*, or FIGS. 4*a* and 4*b*. In other words, the conventional configured heating head 10 as shown in FIG. 8, which is to heat by making in contact with the surface of the heating resistive element 52, the rubber roller 32 touches the surface of heating resistive element 52 directly, not only the surface of the heating resistive element 52 can be damaged easily, but also it cannot be used for heating the rubber roller 62 when there are multiple number of heating resistive elements 52 and the contacting face to rubber roller 62 becoming irregular which causes additional wearing of heating resistive element 52.

On the other hand, if there is no spacer 8 on the heating head 10 configuration in FIG. 1*b*, the rubber roller 32 touches the heating head 10 directly without spacer 8, since the contact face of heating head 10 is the backside of the head substrate board 1 and flat, so it will contact evenly with rubber roller 32. The head substrate board 1 is usually made of ceramics such as alumina and the surface is hard and cores in general, there is a problem of rubber roller 32 surface wearing out. However, by either attaching the spacer 8 on the heating head 10 as shown in FIG. 1*b* or placing a spacer 8 which is made of smooth surface metal sheet of 0.1 to 0.3 mm thickness, between the heating head 10 and the rubber roller 32, it is possible to transfer the heat from heating head 10 to rubber roller for heating (heating roller 33) without the problem of wear, thus giving good durability.

The positional relation between the rubber roller 32 and heating head 10 becomes important, when the heating roller 33 is employed. In other words, since the rubber roller 32 is the mechanism to heat the media 31 by supplying heat contacting media 31 as the heated part rotating to the position with the heat received from heating head 10, it is necessary to reach to the position to contact with media 31 by rotation of rubber roller 32 as quickly as possible. Therefore, it is necessary for the heating head 10 to be installed near the contacting position of rubber roller 32 and media 31; besides it must be located upstream. The upstream side means the side before reaching the point where the rubber roller 32 and media 31 make contact. For example, in the embodiment of upper rubber roller 32 in FIG. 5, the rubber roller 32 turns clockwise and the contacting point with media 31 is at the bottom end, and upstream means the right side from the bottom end, and for the lower rubber roller 32, it is counter-clock-wise and the contacting point is at the top end and the upstream means the right side from the top end. In addition, it is clear that the heating head 10 is better to be as close to possible to the contacting point of the rubber roller 32 and the media 31 from the standpoint of preventing heat diffusion due to radiation between the heating head 10 and the contacting point with media 31; install the heating head 10 nearest to the contacting point with 31 in consideration of space. Thus, heating head 10 is oriented with the spacer 8 facing the surface of the rubber roller 32, and in close proximity. As shown in FIG. 5, spacer 8 is nearly touching the surface of rubber roller 32.

In addition, the temperature drop because of the heat diffusion due to radiation between the heating head 10 and the contacting point with media 31 is about constant once the distance is fixed based on each apparatus; there is no problem if the heating temperature of heating head 10 is raised by measuring the temperature drop beforehand.

The heating apparatus 15 by the technology shown in FIG. 5 is suitable for the recent energy-saving equipment, as there is no need for un-necessary heating and highly thermally efficient since only part of heating roller 33 which is necessary to heat media 31 is heated and the part where the temperature is raised on heating roller 33 is pressed against media 31 to heat. Besides, heating head 10 is heated with the head substrate board 1 which is heated by the heating resistive element 2 temperature rise, the temperature of head substrate board 1 can be controlled accurately through the heating resistive element 2 and media 31 can be heated with very precise temperature. Additionally, according to this technology, the rubber roller 32 will not wear out even without doing any special surface treatment on the pressing side of head substrate board 1 of heating head 10 since the rubber roller 32 is pressed through smooth spacer 8, though contacting side of the rubber roller 32 to the heating head 10 is the flat side where the heating resistive element 2 is not installed.

The heating apparatus 15 configuration of installing heating rollers on both sides of media 31 as shown in FIG. 5 is especially suitable for the application of fusing for an electrophotographic printer. In other words, in an electro-photographic printer, the photoconductive drum is charged while rotating, a latent electrostatic image is formed with laser light or LED light, the toner is attached to develop the image in the developer and the visible image is made. Then, toner is transferred from the photoconductive drum to the paper by static electricity and the toner transferred to paper is fused on the paper by heat and pressure and exit the printer. To fuse the toner transferred to the paper, by using the heating apparatus 15 as shown in FIG. 5 where heating rollers are installed on both sides of media 31 and the toner is fused firmly on the media 31 in a short time by heating from both sides. In other words, very stable fusing is possible by the rollers heating on both sides uniformly even with a small and simple configuration. Additionally, installation of multiple photoconductive drums and fusing parts combination such as black (K), cyan (C), magenta (M) and yellow (Y) are needed for color printing.

The heating apparatus 15 previously described in FIG. 2 or FIG. 5 are showing only one unit of heating section, but by using multiples of the heating apparatus 15, heat-up can be repeated and the temperature raise time is shortened compared to a single unit. Heating can be done in faster and media transfer speed can be increased, though the power consumption increases.

The heating head of this technology can be used for recording and erasing of thermal rewritable media by heating, thermal transfer ribbon image transfer and retransfer by heating, toner fusing, adhesion, fusion and forming process by heating, over-coating in order to protect the surfaces of documents and images from solvents, gases and light, lamination process of documents, spot adhesion on sheets with the heat-curing adhesive sheet, imprinting process by heat forming the plastic surface texture.

Reference Numbers used in the Drawings are as follows:

1 Head substrate board
1*a* First side
1*b* End surface
1*c* Second side
2 Heating resistive element
3 Electrode
4 Base
5 Wiring board
6 Thermal insulation board
6*a* First thermal insulation board
6*b* Second thermal insulation board
6*c* Insulation spacer
7 Adhesive
8 Spacer
8*a* end
9*a* Presser bar
9*b* Screw
10 Heating head
15 Heating apparatus
21 DC Power Source
23 Standard Resistor
24 Temperature Detection Means
25 Control Means
31 Media
32 Rubber Roller
32*a* Surface Layer
32*b* Inner Layer
32*c* Rotation Shaft
33 Heating Roller
51 Head Substrate Board
52 Heating Resistive Element
53 Electrodes
54 Base
55 Adhesive
62 Rubber roller Although this technology has been illustrated and described herein with reference to preferred embodiments and specific examples thereof, it will be readily apparent to those of ordinary skill in the art that other embodiments and examples can perform similar functions and/or achieve like results. All such equivalent embodiments and examples are within the spirit and scope of the invention and are intended to be covered by the following claims.

What is claimed is:

1. A heating head assembly comprising:
a. a base;
b. a wiring board attached to the base, the wiring board further comprising a pair of electrode terminals;
c. a thermal insulating board connected to the wiring board;
d. at least one strip-shaped heating resistive element;
e. a head substrate board having a media facing side, a pressing side and a heating resistive element side; and
f. a spacer, the pair of electrode terminals connecting the heating resistive element to the wiring board in order to supply voltage, the head substrate board connected on its heating resistive element side to the heating resistive element, the spacer connected to the head substrate board on its pressing side, the spacer extending from the pressing side, past the media facing side to attach to the wiring board.

2. The heating head assembly of claim 1, the spacer selected from the group consisting of copper sheet, stainless steel sheet, and phosphor-bronze sheet.

3. A heating apparatus comprising:
a. a heating head comprising a head substrate board having a first side and a second side, the head substrate board connected to a strip-shaped heating resistive element on the first side of the head substrate board;
b. a roller facing a contacting side of the heating head;
c. a heating device configured for heating up the media while the media is transported between the roller and the heating head;
d. a metal spacer positioned between the heating head and the media, a portion of the metal spacer attached to a portion of the second side of the head substrate board.

4. A heating apparatus comprising:
a. a first heating roller;
b. a second heating roller having a roller surface;
c. a heating head, said heating head having at least one strip-shaped heating resistive element, and a metal spacer, wherein said heating head is oriented with said metal spacer facing said roller surface of said second roller, and wherein said spacer is stationary and is in close proximity to said roller surface.

5. A heating apparatus configured for fusing toner transferred onto a media, the heating apparatus comprising:
a. a first heating roller having a roller surface positioned above said media; and
b. a first heating head fixedly attached, said first heating head having at least one strip-shaped heating resistive element, and a first metal spacer, wherein said first heating head is oriented with said first metal spacer facing said roller surface of said first roller, wherein said first metal spacer is in close proximity to said roller surface; and c. a second heating roller having a roller surface positioned below said media; and d. a second heating head fixedly attached, said second heating head having at least one strip-shaped heating resistive element, and a second metal spacer, wherein said first heating head is oriented with said second metal spacer facing said roller surface of said second roller, wherein said second metal spacer is in close proximity to said roller surface of said second roller; and e. said first heating roller and said second heating roller apply opposing pressure to said media.

6. A method of media heating comprising:

a. pressing a transporting media in sliding contact with a stationary portion of a head substrate board which is not installed with a heating resistive element through a spacer and facing outward, where a heating head is comprised of a head substrate board which has at least one strip-shaped heating resistive element on at least one side of plate-shaped head substrate which is attached to a base.

7. A method of heating media comprising:

a. pressing a media;

b. transporting the media between two facing rollers wherein at least one roller is a heating roller;

c. heating by the heating roller upstream;

d. pressing by the roller through a metal spacer placed on a heating head to heat up a surface of the heating roller wherein sliding contact occurs between said heating roller and said spacer.

* * * * *